US006842161B2

(12) United States Patent
Song et al.

(10) Patent No.: US 6,842,161 B2
(45) Date of Patent: Jan. 11, 2005

(54) METHOD AND APPARATUS FOR DRIVING LIQUID CRYSTAL PANEL IN DOT INVERSION

(75) Inventors: Hong Sung Song, Kyungsangbuk-do (KR); Yong Chae Jung, Kyungsangbuk-do (KR)

(73) Assignee: LG.Philips LCD Co., Ltd., Seoul (KR)

( * ) Notice: Subject to any disclaimer, the term of this patent is extended or adjusted under 35 U.S.C. 154(b) by 221 days.

(21) Appl. No.: 09/862,501

(22) Filed: May 23, 2001

(65) Prior Publication Data

US 2002/0024482 A1 Feb. 28, 2002

(30) Foreign Application Priority Data

Aug. 30, 2000 (KR) ..... 2000-50589

(51) Int. Cl.[7] ..... G09G 3/36

(52) U.S. Cl. ..... 345/87; 345/96; 345/99; 345/209

(58) Field of Search ..... 345/87, 88, 90, 345/91, 92, 93, 94, 95, 96, 204–206, 98–100, 208, 209, 210

(56) References Cited

U.S. PATENT DOCUMENTS 5,923,310 A * 7/1999 Kim ..... 345/90
6,335,719 B1 * 1/2002 An et al. ..... 345/98
6,342,876 B1 * 1/2002 Kim ..... 345/87
6,400,350 B1 * 6/2002 Nishimura et al. ..... 345/96
6,549,187 B1 * 4/2003 Matsubara et al. ..... 345/96
6,583,778 B1 * 6/2003 Nishimura et al. ..... 345/96
2002/0075212 A1 * 6/2002 Song ..... 345/87
2002/0154085 A1 * 10/2002 Kim ..... 345/96
2003/0025662 A1 * 2/2003 Park ..... 345/88

FOREIGN PATENT DOCUMENTS

JP 4338716 11/1992
JP 5313191 11/1993
JP 7318898 12/1995
JP 11352462 12/1999

OTHER PUBLICATIONS

Search Report; Japanese Patent Office; Jul. 27, 2004, no English translation.

* cited by examiner

*Primary Examiner*—Regina Liang
(74) *Attorney, Agent, or Firm*—McKenna Long & Aldridge LLP

(57) ABSTRACT

A liquid crystal panel driving method and apparatus for a dot-inversion system is adaptive for constantly maintaining a voltage applied to each liquid crystal cell, wherein a 'n−1'th(n≧2) cell of adjacent pixel cells is charged and then a nth cell thereof is charged for a shorter time period than the 'n−1'th(n≧2) cell. Accordingly, the liquid crystal cells positioned adjacent to each other receive video signals having the same polarity during a different time period. Therefore, the liquid crystal cells positioned adjacent to each other to receive video signals having the same polarity can be coupled with an equal voltage.

19 Claims, 10 Drawing Sheets

FIG. 3
CONVENTIONAL ART

| | | | | | | | |
|---|---|---|---|---|---|---|---|
| + | − | + | − | + | − | + | − |
| − | + | − | + | − | + | − | + |
| + | − | + | − | + | − | + | − |
| − | + | − | + | − | + | − | + |
| + | − | + | − | + | − | + | − |
| − | + | − | + | − | + | − | + |
| + | − | + | − | + | − | + | − |
| − | + | − | + | − | + | − | + |

FIG. 5
CONVENTIONAL ART

| | | | | | | | |
|---|---|---|---|---|---|---|---|
| + | − | + | − | + | − | + | − |
| + | − | + | − | + | − | + | − |
| − | + | − | + | − | + | − | + |
| − | + | − | + | − | + | − | + |
| + | − | + | − | + | − | + | − |
| + | − | + | − | + | − | + | − |
| − | + | − | + | − | + | − | + |
| − | + | − | + | − | + | − | + |

METHOD AND APPARATUS FOR DRIVING LIQUID CRYSTAL PANEL IN DOT INVERSION

This application claims the benefit of Korean Patent Application No. 2000-50589, filed on Aug. 30, 2000, the entirety of which is hereby incorporated by reference for all purposes as if fully set forth herein.

BACKGROUND OF THE INVENTION

1. Field of the Invention

The present invention relates to a technique for driving a liquid crystal display device, and more particularly to a liquid crystal panel driving method and apparatus of a dot-inversion system that is capable of constantly maintaining a quantity of a voltage applied to a liquid crystal cell.

2. Discussion of the Related Art

Generally, a liquid crystal display (LCD) displays a picture corresponding to a video signal using a pixel matrix arranged at each intersection between gate lines and data lines. As shown in FIG. 1, each pixel includes a liquid crystal pixel cell (labeled "LC" in FIG. 1) for controlling a transmitted light quantity in accordance with a video signal, a thin film transistor 2 or 4 for switching the video signal to be applied to the cell LC from a data line DL, and a gate line GL for applying a gate driving signal so that the video signal from the data line DL can be applied to the cell LC. Also, the LCD is provided with gate and data driving integrated circuits (IC's) (not shown) for applying driving signals to the gate line GL and the data line DL, respectively.

Such an LCD has typically used three driving methods such as a frame-inversion method, a line-inversion method, and a dot-inversion method, so as to drive the liquid crystal cells LC of the liquid crystal display panel. In the frame-inversion driving method, the polarity of a data signal applied to each liquid crystal cell is inverted when a frame is changed. In the line-inversion driving method, the polarity of a data signal applied to each liquid crystal cell is inverted depending on the line in the LCD panel, that is, the polarity is inverted with respect to alternating gate lines. In the dot-inversion system, data signals having an opposite polarity are applied to adjacent liquid crystal cells and the polarity of a data signal applied to each liquid crystal cell is inverted every frame. Of the three LCD panel driving methods, the dot-inversion system allows a data signal having a polarity contrary to data signals applied to the adjacent liquid crystal cells in the vertical and horizontal directions to be applied to a certain liquid crystal cell, thereby providing a picture having a better quality than the frame- and line-inversion systems. In light of this advantage, recently LCD panels have mainly used the dot-inversion driving method or system. Dot-inversion systems are classified into 1-dot inversion systems and 2-dot inversion systems.

The 1-dot inversion system will be described in detail with reference to a waveform diagram of FIG. 2. First, a polarity pulse and a data output enable signal are each input to a data driving IC (not shown). In the 1-dot inversion system, the data output enable signal inputted to the data driving IC has twice the frequency of the polarity pulse. The data driving IC receiving the polarity pulse and the data output enable signal applies a video signal synchronized with the falling edge (or rising edge) of the data output enable signal to the data line DL. At this time, the video signal applied from the data driving IC to the data line DL alternately has a positive (+) polarity and then a negative (−) polarity alternately as shown in FIG. 2. Further, a gate output enable signal having the same frequency as the data output enable signal is applied to a gate driving IC. The gate driving IC generates a gate driving pulse by utilizing the gate output enable signal applied thereto and sequentially applies the generated gate driving pulse to the gate lines GL. In such a 1-dot inversion system, both the liquid crystal cells LC positioned adjacently having the gate line GL therebetween, and the liquid crystal cells LC positioned adjacently having the data line DL therebetween, are Supplied signals having an opposite polarity to thereby display a picture.

However, such a 1-dot inversion system has a large power consumption because all of the adjacent liquid crystal cells have a different polarity. In order to mitigate such a disadvantage, a 2-dot inversion system has been used.

The 2-dot inversion system will be described in detail with reference to a waveform diagram as shown in FIG. 4. First, a polarity pulse and a data output enable signal are input to the data driving IC. In the 2-dot inversion system, the data output enable signal input to the data driving IC has four times the frequency of the polarity pulse. The data driving IC receiving the polarity pulse and the data output enable signal generates a video signal synchronized with the falling edge (or rising edge) of the data output enable signal and applies the generated video signal to the data line DL. At this time, since the data output enable signal has four times the frequency of the polarity pulse, video signals are successively applied twice when the polarity pulse has a positive (+) polarity while video signals are then successively applied twice when the polarity pulse has a negative (−) polarity.

Further, a gate output enable signal having the same frequency as the data output enable signal is applied to the gate driving IC. The gate driving IC generates a gate driving pulse by utilizing the gate output enable signal applied thereto and sequentially applies the generated gate driving pulse to the gate lines GL. In such a 2-dot inversion system, as shown in FIG. 5, positive (+), positive (+), negative (−) and negative (−) polarities are alternately repeated in the vertical direction, while positive (+) and negative (−) polarities are alternately repeated in the horizontal direction. Accordingly, the 2-dot inversion system can reduce power consumption in comparison with the 1-dot inversion system in which an opposite polarity is applied to all of the liquid crystal cells LC.

In such a conventional 2-dot inversion system, however, a voltage value applied to a terminal "A" shown in FIG. 1 is different from a voltage value applied to a terminal "B" in FIG. 1. This will be described in detail, assuming that a positive (+) video signal should be currently applied to the data line DL while a voltage of 0V or less should have been previously applied to the data line DL. First, a gate signal is applied to the (n−1)th gate line GL, and a positive (+) video signal synchronized with the gate signal is applied to the data line DL. At this time, since a voltage of 0V or less has been applied to the data line DL prior to an input of the positive (+) video signal to the data line DL, a desired voltage rise time is required when the positive (+) video signal is applied to the terminal A. After the video signal is applied to the terminal A, a gate signal is applied to the nth gate line GL, and a positive (+) video signal synchronized with the gate signal is applied to the data line DL. In other words, a load on the data line when a video signal is applied to the terminal A is different from a load on the data line when a video signal is applied to the terminal B. Thus, as shown in FIG. 4, a voltage difference 8 is generated between a voltage applied to the terminal A and a voltage applied to the terminal B. Ultimately, even when the same video data is supplied, the same voltage is not applied to the liquid crystal cells LC positioned adjacently to each other to receive a video signal having the same polarity. This results in the LCD producing a cross line dimness, etc.

SUMMARY OF THE INVENTION

Accordingly, the present invention is directed to a method and apparatus for driving liquid crystal panels in dot inversion that substantially obviates one or more of the problems due to limitations and disadvantages of the related art.

An object of the present invention is to provide a liquid crystal panel driving method and apparatus of a dot-inversion system that is adaptive for constantly maintaining a voltage applied to each liquid crystal cell.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, a dot-inversion driving method for a liquid crystal display panel according to one aspect of the present invention includes the steps of charging a 'n−1'th ($n \geqq 2$) cell of the adjacent pixel cells; and charging a nth cell thereof at a shorter time than the 'n−1'th($n \geqq 2$) cell.

A liquid crystal display according to another aspect of the present invention includes a liquid crystal display panel having a plurality of data lines, a plurality of gate lines, thin film transistors arranged at each intersection between the data lines and the gate lines and liquid crystal cells connected to the thin film transistors; a gate driver connected to the gate lines of the liquid crystal display panel; and a data driver connected to the data lines of the liquid crystal display panel, wherein video signals having an opposite polarity are applied to the liquid crystal cells being adjacent to each other in the horizontal direction while being alternately applied to liquid crystal cell pairs each of which consists of two liquid crystal cells being adjacent to each other in the vertical direction, and video signals having the same polarity are applied to the two liquid crystal cells of each liquid crystal cell pair for a different time.

A liquid crystal display according to still another aspect of the present invention includes a liquid crystal display panel having a plurality of data lines, a plurality of gate lines, thin film transistors arranged at each intersection between the data lines and the gate lines and liquid crystal cells connected to the thin film transistors; a gate driver connected to the gate lines of the liquid crystal display panel; and a data driver connected to the data lines of the liquid crystal display panel, wherein the data driver applies video signals having an opposite polarity to the liquid crystal cells being adjacent to each other in the horizontal direction while it alternately applies them to liquid crystal cell pairs each of which consists of two liquid crystal cells being adjacent to each other in the vertical direction, and the data driver applies video signals having the same polarity to the two liquid crystal cells of each liquid crystal cell pair for a different time.

A liquid crystal display according to still another aspect of the present invention includes a liquid crystal display panel having a plurality of data lines, a plurality of gate lines, thin film transistors arranged at each intersection between the data lines and the gate lines and liquid crystal cells connected to the thin film transistors; a gate driver connected to the gate lines of the liquid crystal display panel to turn on a gate of the thin film transistor connected to each gate line; and a data driver connected to the data lines of the liquid crystal display panel, wherein the data driver applies video signals having an opposite polarity to the liquid crystal cells being adjacent to each other in the horizontal direction while it alternately applies them to liquid crystal cell pairs each of which consists of two liquid crystal cells being adjacent to each other in the vertical direction, and the data driver applies video signals having the same polarity to the two liquid crystal cells of each liquid crystal cell pair; and the gate driver sequentially outputs gate driving pulses in which a turn-on time at the upper liquid crystal cell of each liquid crystal cell pair is different from a turn-on time at the lower liquid crystal cell thereof.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings:

FIG. 3 illustrates a polarity pattern of data signals applied to the liquid crystal cells in accordance with the waveforms shown in FIG. 2;

FIG. 5 illustrates a polarity pattern of data signals applied to the liquid crystal cells in accordance with the waveforms shown in FIG. 4;

DETAILED DESCRIPTION OF THE PREFERRED EMBODIMENTS

Reference will now be made in detail to the preferred embodiments of the present invention, examples of which are illustrated in the accompanying drawings.

Figure 1:
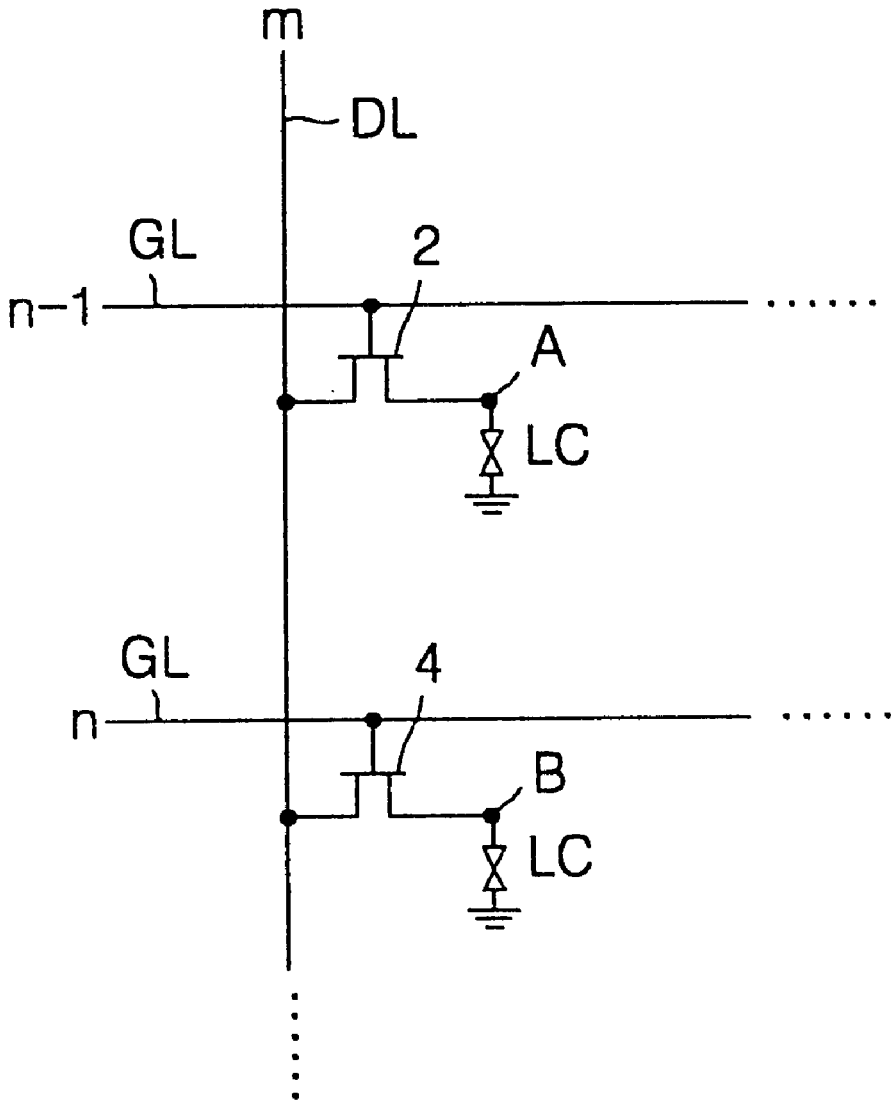
FIG. 1 CONVENTIONAL ART
FIG. 1 is a schematic view of liquid crystal cells arranged at intersections between data lines and gate lines.
Figure 2:
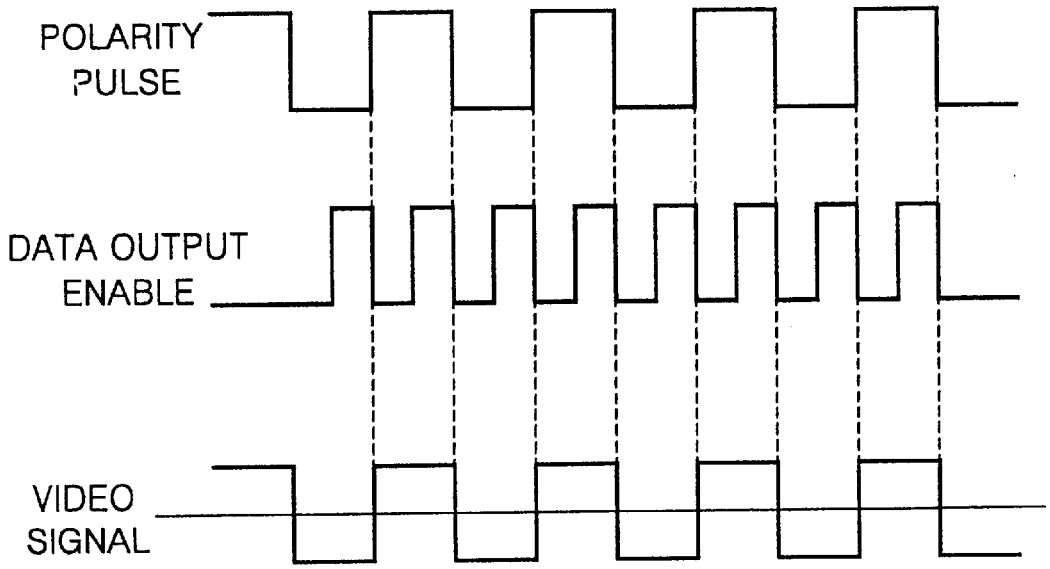
FIG. 2 CONVENTIONAL ART
FIG. 2 shows waveform diagrams of a polarity pulse and a data output enable signal input to a data driving IC and a video signal output from a gate driving IC in a 1-dot inversion driving method.
Figure 4:
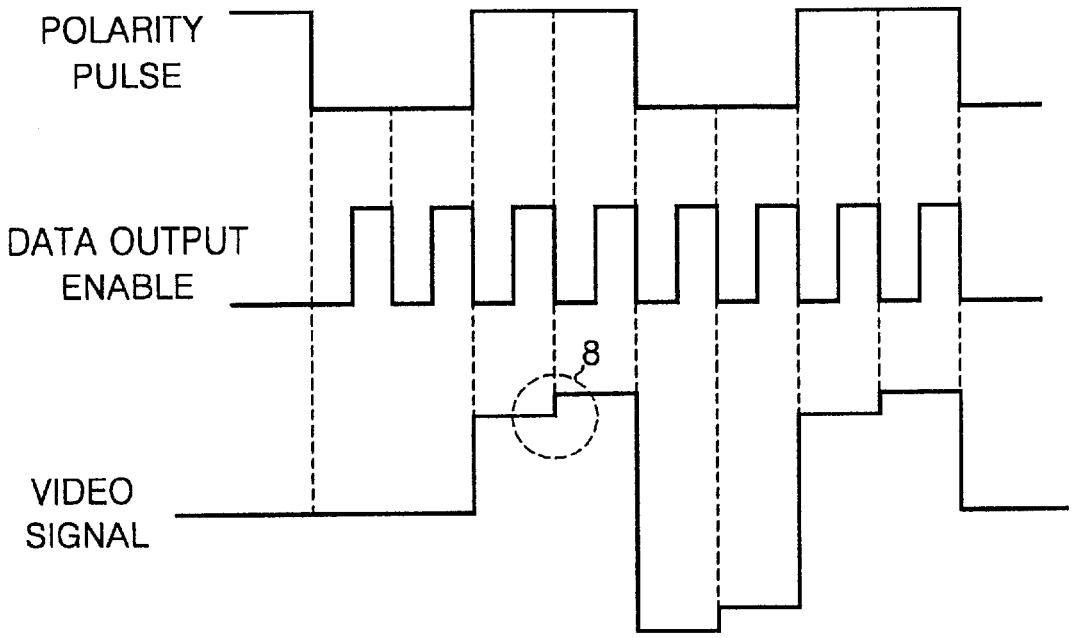
FIG. 4 CONVENTIONAL ART
FIG. 4 shows waveform diagrams of a polarity pulse and a data output enable signal input to a data driving IC in a 2-dot inversion driving method.
Figure 6:
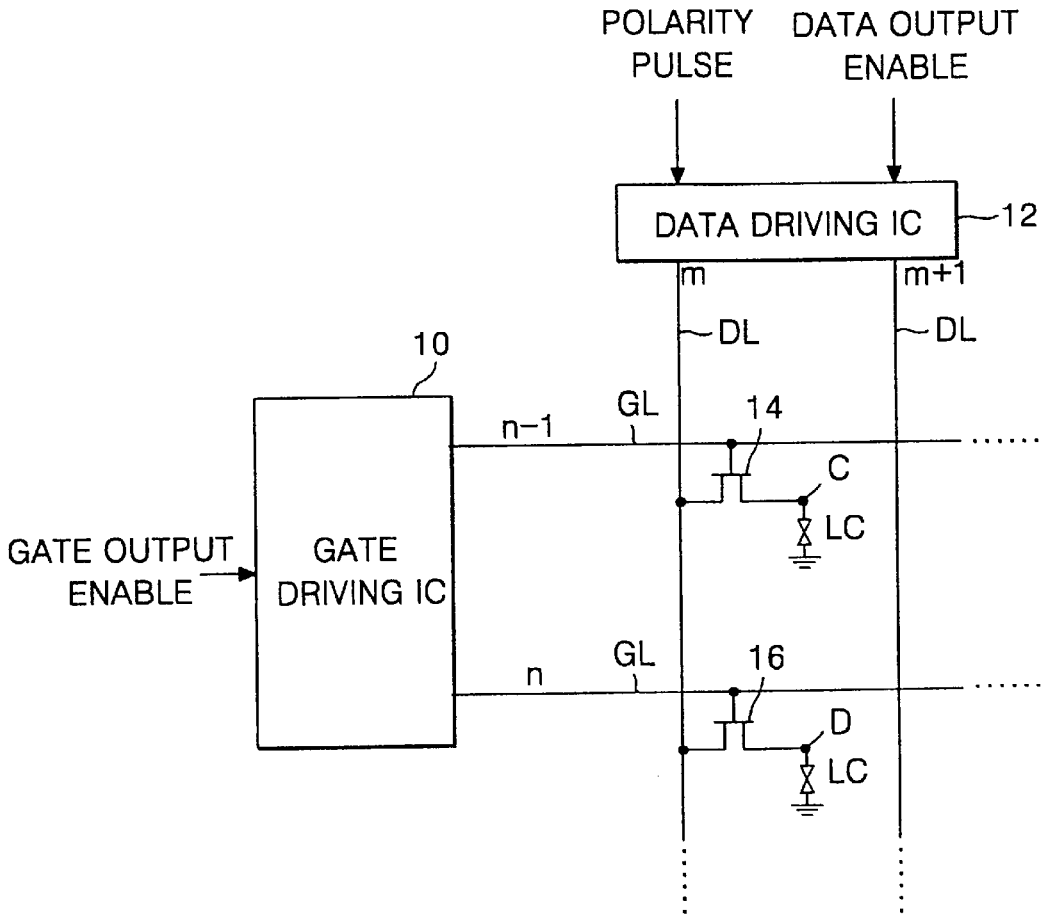
FIG. 6 is a schematic view showing a configuration of a liquid crystal display panel driving apparatus according to a preferred embodiment.

Referring to FIG. 6, there is shown a liquid crystal display (LCD) panel driving apparatus. The LCD panel driving apparatus includes a gate driving IC 10 for driving gate lines GL on a divisional basis, and a data driving IC 12 for applying video signals to data lines DL. The LCD panel is provided with a plurality of liquid crystal cells LC and TFT's 14 and 16 for switching video signals to be applied to these liquid crystal cells LC. The liquid crystal cells are arranged at each intersection between the data lines DL and the gate lines GL, and the TFT's 14 and 16 are positioned at said intersections. The gate driving IC 10 sequentially applies a gate driving pulse to the gate lines GL to sequentially drive the gate lines GL. Then, the TFT's 14 and 16 on the LCD panel are sequentially driven for each one gate line to sequentially apply video signals to the liquid crystal cells LC for each one gate line. The data driving IC 12 applies video signals to the data lines DL whenever the gate driving pulse is generated.

Figure 7:
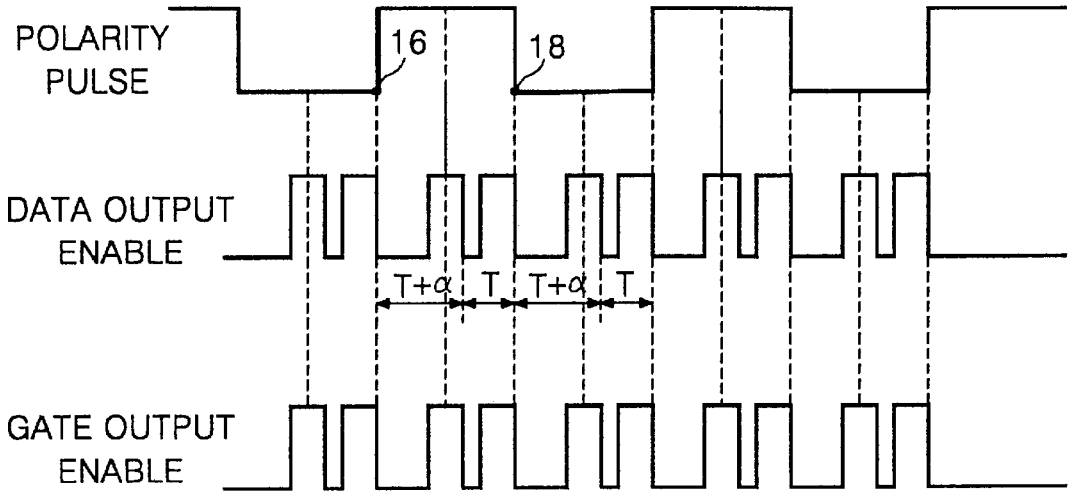
FIG. 7 shows waveform diagrams of a polarity pulse and a data output enable signal input to a data driving IC and a gate output enable signal input to a gate driving IC by means of the driving apparatus according to a first embodiment.
Figure 8:
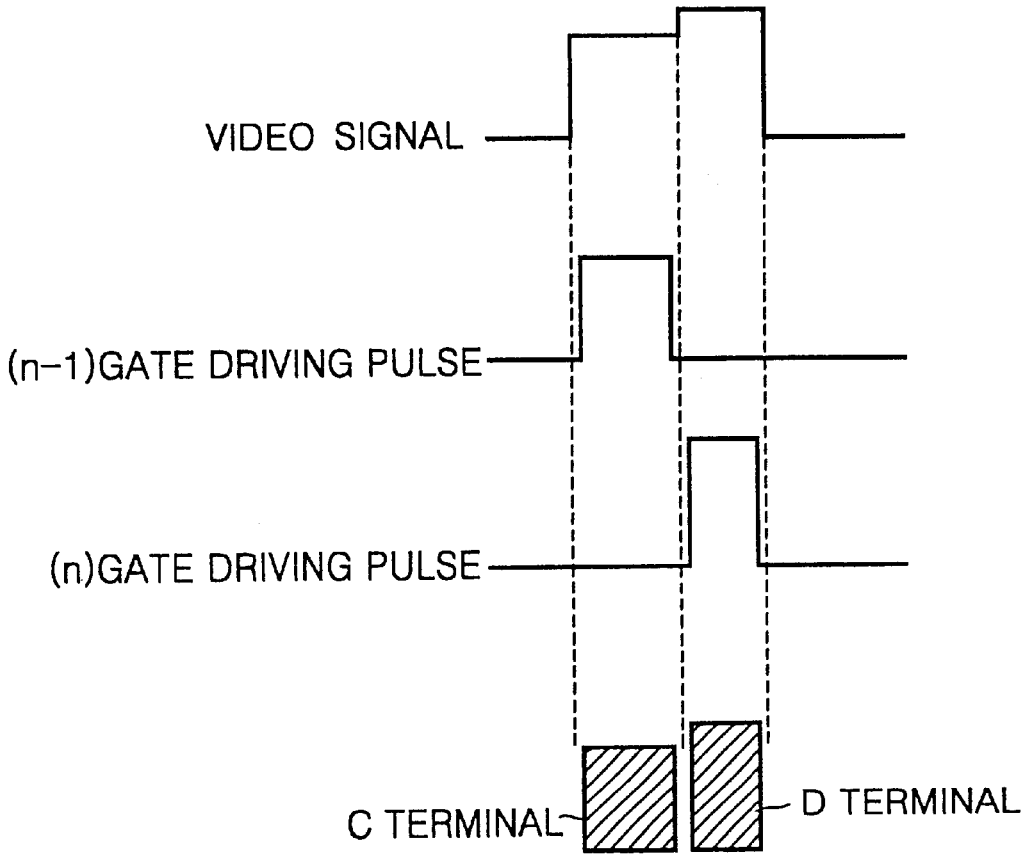
FIG. 8 illustrates a video signal and a gate driving pulse generated by the waveforms shown in FIG. 7.

FIG. 7 illustrates pulses applied to the data driving IC and the gate driving IC in FIG. 6. Referring to FIG. 7, there are shown a polarity pulse signal and a data output enable signal applied to the data driving IC 12, and a gate output enable signal applied to the gate driving IC 10. The data output enable signal and the gate output enable signal each have four times the frequency of the polarity pulse. Thus, two data output enable signal cycles are positioned between a first polarity transition time 16 of the polarity pulse and the next polarity transition time 18 thereof. The two data output enable signal cycles positioned between the polarity transition time 16 and the next polarity transition time 18 have periods T+α and T, respectively. More specifically, the data output enable signal cycle input at the polarity transition time 16 of the polarity pulse has a wide period T+α while the data output enable signal cycle input before the next polarity transition time 18 has a narrow period T. As shown in FIG. 7, the gate output enable signal input to the gate driving IC 10 has the same period and frequency as the data output enable signal. The data driving IC 12 receiving the polarity pulse and the data output enable signal applies a video signal to the data lines DL in synchronization with the falling edge of the data output enable signal. At this time, since the data output enable signal cycles have different periods T+α and T within a single polarity pulse, a video signal as shown in FIG. 8 is applied to the data line DL. In other words, a video signal applied to the TFT 14 provided at the (n−1)th gate line GL has a wider period than a video signal applied to the TFT 16 provided at the nth gate line GL. The gate driving IC 10 receives the gate output enable signal to generate a gate driving pulse and sequentially applies the generated gate driving pulse to the gate lines GL. At this time, since the gate output enable signal has two cycles having different periods T+α and T within a single polarity pulse, a gate driving pulse as shown in FIG. 8 is applied to the gate line GL. In other words, a gate driving pulse applied to the (n−1)th gate line GL has a wider period than a gate driving pulse applied to the nth gate line GL. Accordingly, the terminal "C" shown in FIG. 6 is supplied with video data during a longer time period than the terminal "D." Thus, an equal voltage is applied to the terminal C and the terminal D. To this end, a period difference α between a data output enable signal cycle input at a data polarity transition time 16 and a data output enable signal cycle input before the next data polarity transition time 18 is determined experimentally so that an equal voltage can be applied to the liquid crystal cells LC which are positioned adjacently to each other to receive a video signal having the same polarity. In the above-mentioned embodiment of the present invention, for example, the same gray level is input to a liquid crystal cell at the (n−1)th line and a liquid crystal cell at the nth line. Also, in order to apply video signals having different gray levels to the vertically adjacent liquid crystal cells, a video signal input period at the first liquid crystal cell has a wider period than a video signal input period at the second liquid crystal cell within the same polarity pulse.

Figure 9:
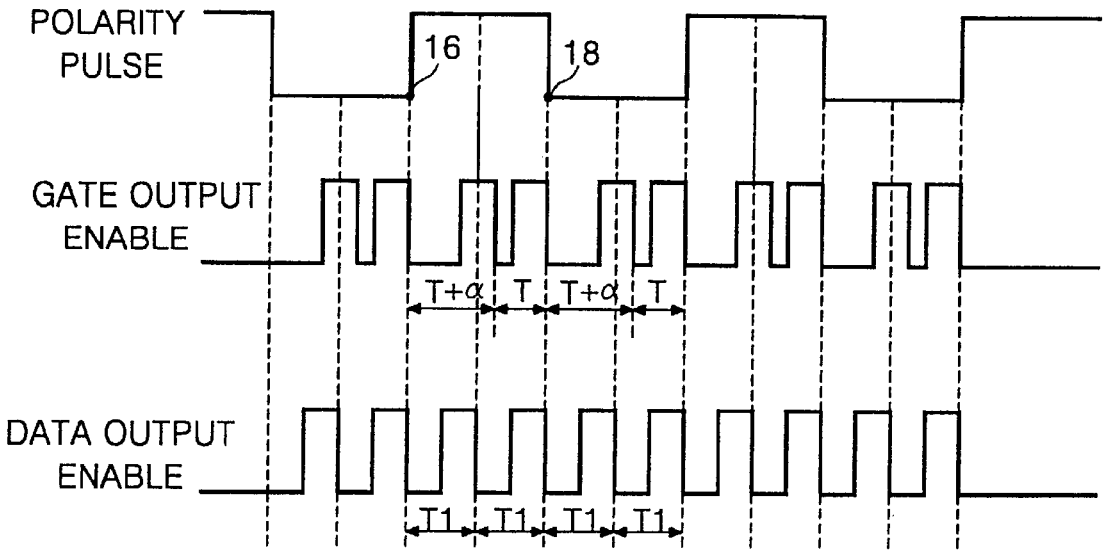
FIG. 9 shows waveform diagrams of a polarity pulse and a data output enable signal input to a data driving IC and a gate output enable signal input to a gate driving IC by means of the driving apparatus according to another embodiment.
Figure 10:
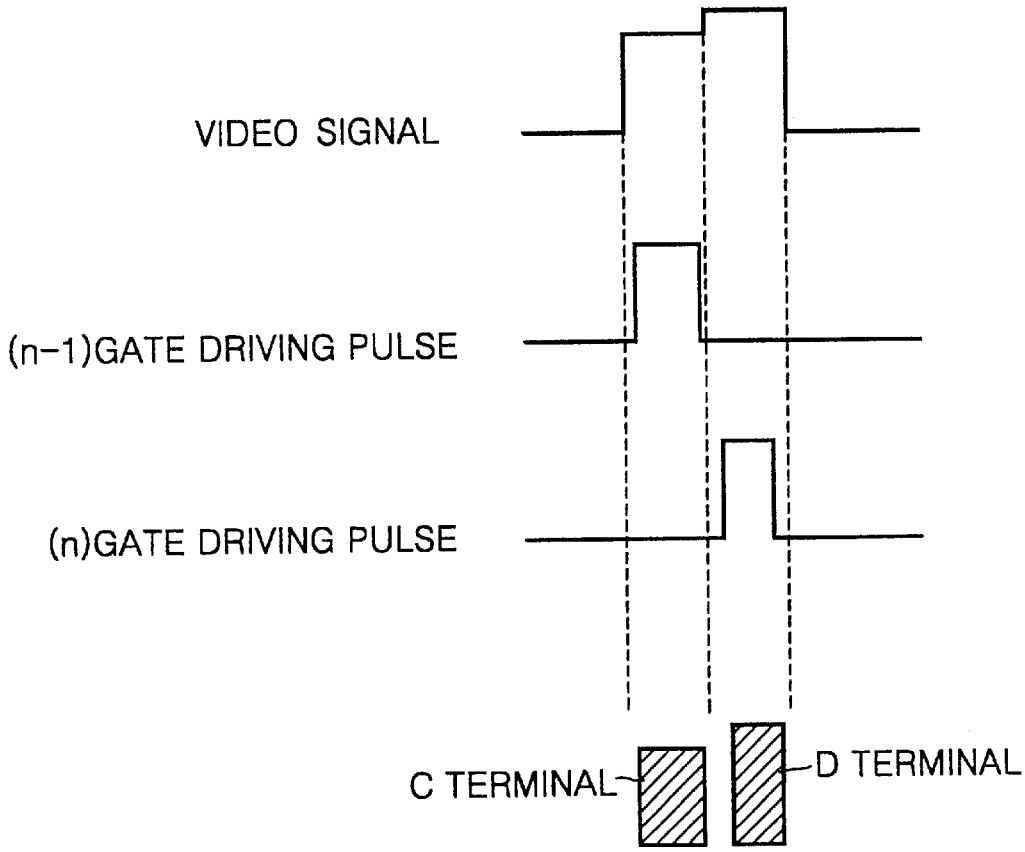
FIG. 10 illustrates a video signal and a gate driving pulse generated by the waveforms shown in FIG. 9.

FIG. 9 illustrates pulses applied to a data driving IC and a gate driving IC according to another embodiment. Referring to FIG. 9, there are shown a polarity pulse signal and a data output enable signal applied to the data driving IC 12, and a gate output enable signal applied to the gate driving IC 10. The data output enable signal and the gate output enable signal each have four times the frequency of the polarity pulse. Thus, two data output enable signals and two gate output enable signals are positioned between a polarity transition time 16 of the polarity pulse and the next polarity transition time 18 thereof. The data output enable signal cycles all have an equal period T1. On the other hand, the gate output enable signal cycles have two different periods, T and T+α. More specifically, the two gate output enable signals positioned between the polarity transition time 16 of the polarity pulse and the polarity transition time 18 thereof have different periods, T+α and T. The data output enable signal input at the polarity transition time 16 of the polarity pulse has a wide period T+α while the data output enable signal input before the next polarity transition time 18 has a narrow period T. The data driving IC 12 receiving the polarity pulse and the data output enable signal applies a video signal to the data line DL in synchronization with the falling edge of the data output enable signal. At this time, since the data output enable signal has two cycles with the same period T1 within a single polarity pulse, a video signal as shown in FIG. 10 is applied to the TFT 14 provided at the (n−1)th gate line GL, and the TFT 16 provided at the nth gate line during the same time. On the other hand, since the gate output enable signal has two cycles with different periods T+α and T within a single polarity pulse, an application time of a gate driving signal to the (n−1)th gate line GL is different from an application time of a gate driving signal to the nth gate line GL. In other words, a gate driving signal applied to the (n−1)th gate line GL is input for a longer time period, by the desired time α, than a gate driving signal applied to the nth gate line GL. Accordingly, the terminal C shown in FIG. 6 is supplied with a video data during a longer time than the terminal D. To this end, a time period difference α between the gate driving signals is determined experimentally so that an equal voltage can be applied to the liquid crystal cells LC which are positioned adjacent to each other to receive video signals having the same polarity. Thus, an equal voltage is applied to the terminal C and the terminal D.

The dot inversion driving method according to the present invention forces nth gate pulse to have a width more narrow than that of 'n−1'th (n≧2) gate pulse, thereby applying to 3, 4, . . . , n dot inversion system as well as the 2 dot inversion system.

As described above, according to the present invention, the liquid crystal cells positioned adjacent to each other receive video signals having the same polarity during different time periods. In other words, the liquid crystal cell receiving the first video signal has a longer input time, by a desired amount, than the input time for the liquid crystal cell receiving the second video signal, so that an equal voltage can be applied to each liquid crystal cell. Accordingly, the liquid crystal cells positioned adjacent to each other to receive video signals having the same polarity can be coupled with an equal voltage.

It will be apparent to those skilled in the art that various modifications and variation can be made in the present invention without departing from the spirit or scope of the invention. Thus, it is intended that the present invention cover the modifications and variations of this invention provided they come within the scope of the appended claims and their equivalents.

What is claimed is:

1. A method of, driving a liquid crystal display panel in dot inversion wherein at least two adjacent liquid crystal pixel cells charged with a same polarity are driven, said method comprising:

applying polarity pulses to a data driving integrated circuit for applying video signals to the pixel cells;

applying a data output enable signal having alternating cycles with different periods from each other to the data driving integrated circuit;

applying a gate output enable signal having alternating cycles each with a same period and frequency as the data output enable signal cycles to a gate driving integrated circuit for applying a gate driving pulse to the pixel cells when the video signals are applied to the pixel cells;

charging a first pixel cell of the adjacent pixel cells; and charging a second pixel cell thereof for a shorter time period then the first pixel cell.

2. The method of claim 1, wherein an application time of the video signals to an upper liquid crystal cell of the liquid crystal cells positioned adjacently to each other at the upper and lower locations to be charged with the same polarity is longer than an application time of the video signals to a lower liquid crystal cell.

3. The method of claim 1, wherein, two data output enable signal cycles are positioned within a single polarity pulse, and wherein said two data output signal cycles have a different period from each other.

4. The method of claim 3, wherein a first cycle of said two data output enable signal cycles has a longer period than a second cycle thereof.

5. The method of claim 1, wherein said two gate output enable signal cycles are positioned within a single polarity pulse, and wherein said two gate output signal cycles have a different period from each other.

6. The method of claim 5, wherein a first cycle of said two gate output enable signal cycles has a longer period than a second cycle thereof.

7. A method of driving a liquid crystal display panel in dot inversion wherein at least two adjacent liquid crystal pixel cells charged with a same polarity are driven, said method comprising:

applying polarity pulses having a different polarity from each other to a data driving integrated circuit for applying video signals to the pixel cells;

applying data output enable signals having a same period as each other to the data driving integrated circuit;

applying gate output enable signals having a different period to a gate driving integrated circuit for applying a gate driving pulse to the pixel cells when the video signals are applied to the pixel cells;

charging a first pixel cell of the adjacent pixel cells; and charging a second pixel cell thereof for a shorter time period than the first pixel cell.

8. The method of claim 7, wherein an application time of the video signals to an upper liquid crystal cell of the liquid crystal cells positioned adjacently to each other at the upper and lower locations to be charged with the same polarity is longer than an application time of the video signals to a lower liquid crystal cell.

9. The method of claim 7, wherein two gate output enable signals are positioned within a single polarity pulse, and wherein the two gate output enable signals have a different period from each other.

10. The method of claim 9, wherein a first gate output enable signal of said two gate output enable signals has a larger period than a second gate output enable signal thereof.

11. A liquid crystal display device, comprising:

a liquid crystal display panel including a plurality of data lines, a plurality of gate lines, thin film transistors arranged at each of a plurality of intersections between the data lines and the gate lines, and liquid crystal cells connected to the thin film transistors;

a gate driver connected to the gate lines of the liquid crystal display panel;

a data driver connected to the data lines of the liquid crystal display panel; and a timing controller supplying polarity pulses and data output enable signals to the data driver and supplying gate output enable signals to the gate driver, the gate output enable signals having a different period from each other and the data output enable signals having a same period as each other, wherein video signals having an opposite polarity are applied to liquid crystal cells adjacent to each other in a horizontal direction, while being alternately applied to liquid crystal cell pairs each of which consists of two liquid crystal cells being a adjacent to each other in a vertical direction, and wherein video signals having a same polarity are applied to the two liquid crystal cells of each liquid crystal cell pair for a different length of time in response to the gate output enable signals.

12. The liquid crystal display device as claimed in claim 11, wherein an application time of the video signals to each upper liquid crystal cell of the liquid crystal cell pairs is longer than an application time of the video signals to each lower liquid crystal cell thereof.

13. A liquid crystal display device, comprising:

a liquid crystal display panel including a plurality of data lines, a plurality of gate lines, thin film transistors arranged at each intersection between the data lines and the gate lines and liquid crystal cells connected to the thin film transistors;

a gate driver connected to the gate lines of the liquid crystal display panel;

a data driver connected to the data lines of the liquid crystal display panel; and a timing controller supplying data output enable signals to the data driver and supplying gate output enable signals to the gate driver, the gate output enable signals having a different period from each other and the data output enable signals having a different period from each other, wherein the data driver applies video signals having an opposite polarity to the liquid crystal cells being adjacent to each other in a horizontal direction while it alternately applies the video signals to liquid crystal cell pairs each of which consists of two liquid crystal cells being adjacent to each other in a vertical direction, and the data driver applies video signals having a same polarity to the two liquid crystal cells of each liquid crystal cell pair for a different length of time in response to the data output enable signals.

14. The liquid crystal display device as claimed in claim 13, wherein an application time of the video signals to each upper liquid crystal cell of the liquid crystal cell pairs is longer than an application time of the video signals to each lower liquid crystal cell thereof.

15. A liquid crystal display device, comprising:

a liquid crystal display panel including a plurality of data lines, a plurality of gate lines, thin film transistors arranged at each intersection between the data lines and the gate lines and liquid crystal cells connected to the thin film transistors;

a gate driver connected to the gate lines of the liquid crystal display panel to turn on a gate of the thin film transistor connected to each gate line;

a data driver connected to the data lines of the liquid crystal display panel; and a timing controller supplying data output enable signals to the data driver and gate output enable signals to the gate driver the gate output enable signals having a different period from each other and the data output enable signals having a same period as each other, wherein the data driver applies video signals having an opposite polarity to the liquid crystal cells being adjacent to each other in a horizontal direction while it alternately applies the video signals to liquid crystal cell pairs each of which consists of two liquid crystal cells being adjacent to each other in a vertical direction, and the data driver applies video signals having a same polarity to the two liquid crystal cells of each liquid crystal cell pair; and the gate driver receives the gate output enable signals and sequentially outputs gate driving pulses in which a turn-on time of an upper liquid crystal cell of each liquid crystal cell pair is different from a turn-on time of a lower liquid crystal cell thereof.

16. The liquid crystal display device as claimed in claim 15, wherein a turn-on time of the gate driving pulse at each upper liquid crystal cell of the liquid crystal cell pairs is longer than a turn-on time of the gate driving pulses at each lower liquid crystal cell thereof.

17. A method of driving a liquid crystal display panel including a plurality of data lines, a plurality of gate lines, thin film transistors arranged at each of a plurality of intersections between the data lines and the gate lines and a plurality of liquid crystal cells connected to the thin film transistors, the plurality of liquid crystal cells divided into at least a first row of horizontally-adjacent first liquid crystal cells and a second row of horizontally-adjacent second liquid crystal cells, each of the second liquid crystal cells of the second row being vertically-adjacent to a corresponding one of the first liquid crystal cells of the first row, the method comprising:

alternately applying first and second data output enable signals with different period from each other;

applying a plurality of first data signals to the first liquid crystal cell of the first row in response to the second data output enable signal, the first data signals applying alternating polarities to every horizontally-adjacent first liquid crystal cell; and applying a plurality of second data signals to the second liquid crystal cells of the second row, the second data signals applying alternating polarities to every horizontally-adjacent second liquid crystal cell and applying a same polarity to each second liquid crystal cell as applied to the vertically-adjacent corresponding one of the first liquid crystal cells, wherein a duration of one of the second data signals applied to one of the second liquid crystal cells is different than a duration of one of the first data signals applied to the vertically-adjacent corresponding one of the first liquid crystal cells.

18. The method of claim 17, wherein the duration of the second data signal applied to the one second liquid crystal cell is less than the duration of the first data signal applied to the corresponding vertically-adjacent first liquid crystal cell.

19. The method of claim 17, wherein the liquid crystal display panel further comprises a third row of horizontally-adjacent third liquid crystal cells, each of the third liquid crystal cells of the third row being vertically-adjacent to a corresponding one of the second liquid crystal cells of the second row, said method further comprising:

applying a plurality of third data signals to the third liquid crystal cell of the third row in response to the first data output enable signal, the third data signals applying alternating polarities to every horizontally-adjacent third liquid crystal cell and applying an opposite polarity as applied to the vertically-adjacent corresponding one of the second liquid crystal cells.

* * * * *